United States Patent [19]

Donnelly

[11] 4,050,110

[45] Sept. 27, 1977

[54] DUST PAN-PUSH BROOM APPARATUS

[76] Inventor: Gerard J. Donnelly, 151 Oakwood Drive, Wayne, N.J. 07470

[21] Appl. No.: 723,093

[22] Filed: Sept. 14, 1976

[51] Int. Cl.[2] ..... A47L 13/52

[52] U.S. Cl. ..... 15/105; 15/257.2

[58] Field of Search ..... 15/104.8, 105, 111, 15/257.1, 257.2, 257.3

[56] References Cited

U.S. PATENT DOCUMENTS

| | | | |
|---|---|---|---|
| 1,349,582 | 8/1920 | Peterson | 15/104.8 |
| 1,424,761 | 8/1922 | Hall | 15/257.9 X |
| 2,455,695 | 12/1948 | Monaco | 15/105 |
| 2,477,876 | 8/1949 | Jaffa | 15/105 |
| 3,082,455 | 3/1963 | Evancha | 15/105 |

*Primary Examiner*—Daniel Blum
*Attorney, Agent, or Firm*—Robert A. Ostmann

[57] ABSTRACT

The disclosure concerns an improved scheme for storing a dust pan on a push broom which is suitable for use with ordinary, commercially available push brooms, and which facilitates mounting and dismounting of the dust pan. The new scheme employs a dust pan having a channel-shaped handle which is adapted to freely receive and extend around the upper surface of the broom handle, and a pan portion which is adapted to underlie the broom handle and be held captive between that handle and a pair of flanking retainers on the brush head.

5 Claims, 5 Drawing Figures

DUST PAN-PUSH BROOM APPARATUS

BACKGROUND OF THE INVENTION

Schemes for storing dust pans on brooms during periods of nonuse as well as during sweeping operations are well known and are attractive because the dust pan always is at hand where and when needed. However, many of the prior proposals are not adaptable to push brooms, and those which are suited to those brooms are either inconvenient to use or require modification of the standard, commercially available push brooms which most people find impractical or impossible to execute.

The object of this invention is to provide an improved scheme for storing a dust pan on a pushbroom which is economical to implement, requires only a very simple modification of the conventional broom, and which allows the pan to be mounted and dismounted quickly and easily. According to the invention the new scheme employs a special dust pan includng a pan portion having an open top, at least in its central region, and a rear wall containing an aperture sized to freely accept the broom handle, and a handle portion which includes a channel section axially aligned with the aperture in said back wall and which also freely receives the broom handle. The channel section opens downward, is spaced from the rear wall of the pan portion a distance greater than the diameter of the broom handle, and is joined to the pan portion solely by an upright member which is arranged to lie along one side of the broom handle. This kind of dust pan mounts on the broom handle, with the channel section extending around the upper surface of the handle and the bottom wall of the pan portion underlying the handle. The pan is retained in place by the joint action of the broom handle and a pair of flanking retainer members which are carried by the brush head, and which are spaced slightly to the rear of the handle. In effect, the retainers and the handle define a gap into which the bottom wall of the pan portion is inserted, and thereby serve to capture and hold that part of the dust pan.

Mounting and dismounting of the dust pan requires only a series of easily executed lateral, pivoting and sliding movements relative to the handle, and all of these movements are of limited extent and none requires the exertion of any appreciable force. Therefore, storage and retrieval of the pan are facilitated. Moreover, since installation of the retainer members is the only modification of the push broom which is needed, and these members may simply be nails or screws driven into the brush head, or angles attached to the head by screws or nails, it is apparent that the invention makes practical utilization of any of the various push brooms available on the commercial market. Finally, it will be noted that the dust pan is carried in such a way that its presence during sweeping operations does not impair the effectiveness of the broom.

BRIEF DESCRIPTION OF THE DRAWINGS

The preferred embodiment of the invention is described herein in detail with reference to the accompanying drawings, in which.

DESCRIPTION OF ILLUSTRATED EMBODIMENT

Figure 1:
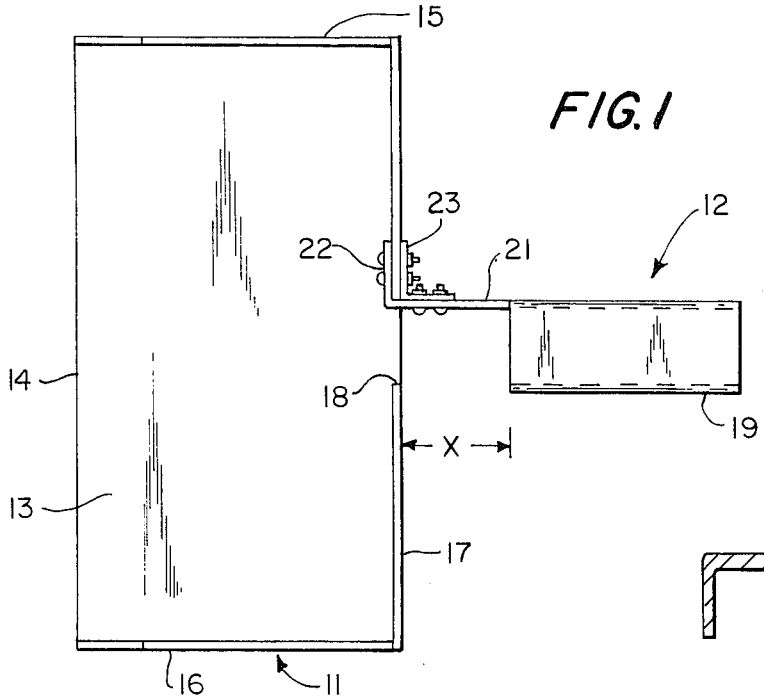
FIGS. 1 and 2 are plan and side elevation views, respectively, of the dust pan.
Figure 3:
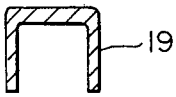
FIG. 3 is a sectional view taken on line 3—3 of FIG. 2.
Figure 2:
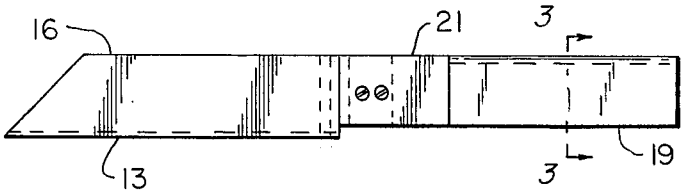

As shown in FIGS. 1-3, the improved dust pan is constructed of sheet metal and comprises a pan portion 11 and a handle portion 12. The pan portion 11 has an open top and front and is defined by a flat, rectangular bottom wall 13 having a straight front edge 14, a pair of end walls 15 and 16, and a rear wall 17. The rear wall contains a centrally located aperture 18, which extends throughout its full height, and which is sized to freely receive the handle of a conventional push broom. An aperture width of about 1¼ inches is considered suitable for the brooms on today's market, which normally employ handles having a diameter on the order to ⅞ inch – 1inch.

The handle portion 12 of the dust pan includes a channel section 19, which opens in the downward direction and is joined to the pan portion by a flat, vertical connecting member 21. The parts 19 and 21 are formed of one piece of material, with the connecting member being an axial prolongation of one of the depending legs of the channel section. The handle is attached to rear wall 17 of pan portion 11 be fasteners, such as screws or rivets, which pass through an outturned flange 22 formed at the inner end of connecting member 21. An angle bracket 23 is included to reinforce the joint.

Channel section 19 is axially aligned with the aperture 18 in rear pan wall 17 and also is sized to freely accept the handles of ordinary push brooms. In addition, it will be noted that section 19 is spaced from rear wall 17 a distance X, which must be greater, and preferably is considerably greater, than the diameter of the broom handle. A spacing of about 2½ inches has proven quite satisfactory in actual practice. Section 19, of course, serves as the grasp of the dust pan, so it must also be designed with this function in mind. A channel 4¾ inches long and having 1¼ inch legs and web is considered an acceptable grasp.

Figure 4:
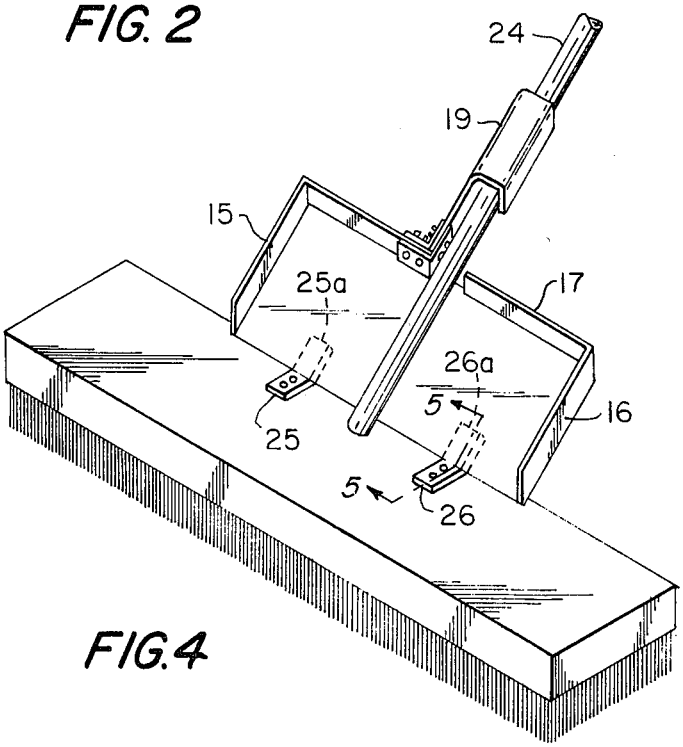
FIG. 4 is a perspective view showing the dust pan mounted on a push broom.
Figure 5:
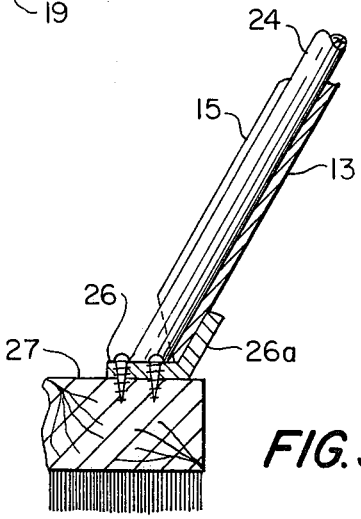
FIG. 5 is an enlarged sectional view taken on line 5—5 of FIG. 4.

The dust pan is stored on a push broom in the manner depicted in FIGS. 4 and 5. It will be noticed in these figures that channel section 19 extends around an upper portion of the broom handle 24, connecting member 21 lies along one side of the handle, and that the bottom wall 13 of the pan underlies the handle. Channel section 19 inherently prevents handle portion 12 from falling from the broom, and the pan portion 11 is held captive by the joint action of broom handle 24 and a pair of flanking retainer members 25 and 26. As illustrated, the retaining members are angle brackets which are attached by screws to the upper surface of the broom head 27, and which are so arranged that their upstanding legs **25*a* and 26*a* lie in a common plane parallel with, and spaced just slightly to the rear of, broom handle 24. In effect, this handle and the retainers 25 and 26 define a gap which receives bottom pan wall 13 as the dust pan is moved downward along handle 24.**

Although the dust pan is retained securely on the push broom during normal sweeping operations, intentional removal is effected easily. Such dismounting involves the simple steps of sliding the pan up along broom handle 24 to a point where edge 14 is beyond angle retainers 25 and 26, then allowing pan portion 11 to tilt downward relatively to handle 24 so that the latter is free of the confines of channel section 19 and the back wall 17, and finally moving the pan laterally away from handle 24. Mounting of the pan is just as easy, for it requires only performance of the same steps in reverse order and with opposite directions of movement.

Except as required by the appended claims, the detailed design of the dust pan and the retainer members is not critical, and may be varied to suit individual preferences. Moreover, the methods and materials used in the construction of these parts is not an aspect of the invention. In fact, it is contemplated that economics may well dictate that the pin be a molded, rigid plastic unit, rather than a bent, sheet metal product.

I claim:

1. A dust pan comprising a. a pan portion defined by a bottom wall, a pair of end walls and a rear wall, and having an open top and front, b. the rear wall containing a centrally located aperture which opens through its upper margin and is sized to freely receive a push broom handle; and c. a handle portion which includes a downwardly opening channel section which is joined to the pan portion solely by an upright connecting member which projects rearwardly from said rear wall and is positioned adjacent one side of said aperture, d. the channel section being axially aligned with said aperture, being sized to freely receive a push broom handle, and being spaced from said rear wall a distance greater than the diameter of a push broom handle.

2. A dust pan as defined in claim 1 in which said bottom wall of the pan portion is flat and has a straight front edge; and said aperture extends throughout the full height of said rear wall.

3. A dust pan as defined in claim 2 in which said connecting member is planar and is formed as an axial prolongation of a depending leg of the channel section.

4. Cleaning apparatus comprising the combination of a. a dust pan as defined in claim 1;

b. a push broom having a brush head and a handle; and c. a pair of retaining members carried by the brush head, located at opposite sides of the handle, and having pan-engaging faces which lie in a plane spaced slightly to the rear of the broom handle, d. whereby the dust pan may be stored on the push broom with the channel section overlying the broom handle and with said bottom wall underlying the broom handle and being held captive against that handle by the retaining members.

5. Cleaning apparatus as defined in claim 4 in which each retaining member is an angle element having one leg attached to the brush head and an upstanding leg on which rests said bottom wall of a stored pan.

* * * * *